US007264505B2

(12) United States Patent
Miyakawa

(10) Patent No.: US 7,264,505 B2
(45) Date of Patent: Sep. 4, 2007

(54) DOUBLE ENGAGED CONNECTOR

(75) Inventor: Tomoyuki Miyakawa, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/445,242

(22) Filed: Jun. 2, 2006

(65) Prior Publication Data

US 2007/0020997 A1 Jan. 25, 2007

(30) Foreign Application Priority Data

Jul. 19, 2005 (JP) ..... 2005-208563

(51) Int. Cl.
*H01R 13/40* (2006.01)

(52) U.S. Cl. ..... 439/595; 439/752

(58) Field of Classification Search ..... 439/595, 439/752, 594, 488, 489
See application file for complete search history.

(56) References Cited

U.S. PATENT DOCUMENTS 4,946,398 A * 8/1990 Takenouchi et al. ..... 439/599
5,061,210 A * 10/1991 Jinno ..... 439/752
5,108,319 A * 4/1992 Tsuji et al. ..... 439/752
5,183,418 A * 2/1993 Yamanashi et al. ..... 439/752
5,931,700 A * 8/1999 Saito et al. ..... 439/595
5,997,352 A * 12/1999 Newport et al. ..... 439/595
6,106,340 A * 8/2000 Myer et al. ..... 439/752

FOREIGN PATENT DOCUMENTS

JP 9-251874 9/1997

* cited by examiner

*Primary Examiner*—Hien Vu
(74) *Attorney, Agent, or Firm*—Kratz, Quintos & Hanson, LLP

(57) ABSTRACT

A double locking connector includes: a connector housing; a double locking member inserted into the connector housing for locking terminals; operational members disposed on the double locking member and exposed outside of the connector housing; slidably engaged members disposed on the operational members; guides disposed on outer walls of the connector housing; and pressing walls disposed on the guides for pressing the slidably engaging parts from outside thereof to prevent the slidably engaging parts from being displaced outward. The slidably engaged members are boards or ribs projected from the boards. The guides are guide rails having an L-shaped section. The operational members have peripheral members in a frame shape and a board disposed in the frame. The guides are inserted into openings formed between the peripheral members and the board.

4 Claims, 9 Drawing Sheets

DOUBLE ENGAGED CONNECTOR

CROSS REFERENCE TO RELATED APPLICATIONS

This application is based on Japanese Patent Applications No. 2005-208563, the content of which is hereby incorporated by reference.

BACKGROUND OF THE INVENTION

1. Field of the Invention

The present invention relates to a double locking connector to prevent terminals from falling out of a connector housing by double engagement.

2. Description of the Related Art

FIGS. 14 to 17 show an embodiment of a conventional double locking connector (see Japanese Patent Application No. H09-251874 (FIGS. 2 to 4)).

A double locking connector 61 includes: a synthetic-resin-made connector housing 62; a synthetic-resin-made front holder 64; a terminal 65 having an electric wire. The front holder 64 is to be inserted into the connector housing 62 through a front opening of a connector engaging chamber 63. The terminal 65 is to be inserted into the connector housing 62 from a rear thereof while the front holder 64 is temporarily locked with the connector housing 62.

As shown in FIG. 15, the terminal 65 is inserted into a terminal-receiving chamber of the connector housing 62, and a resilient locking lance 66 in the connector housing 62 locks the terminal 65 simultaneously. Then, as shown in FIG. 16, after the front holder 6 is pushed backward, a double locking plate 67 penetrates into a flexible room of the locking lance 66 to prevent the locking lance 66 to move, namely, to be double locking. Simultaneously, the front holder 64 is regularly locked with the connector housing 62. FIG. 15 shows the front temporarily locked holder 64. FIGS. 14 and 16 show the regularly locked front holder 64.

As shown in FIG. 14, the front holder 64 includes: a resilient locking arm 69 on a top of a frame 68; and a pair of operational members 70 on both left and right sides of the frame 68. The operational members 70 are slidable back and force in a flat groove 71 formed on a sidewall of the connector housing 62.

As shown in FIG. 15, the front holder 64 is temporarily locked in a state that a projection 72 of the resilient locking arm 69 is in front of a projection 73 of a top wall of the connector housing 62. When the operational members 70 are pulled backward from the temporary locking state, the projection 72 is carried over the projection 73 and the front holder 64 is regularly locked to be prevented from falling out forward. Pushing the operational members 70 forward shifts the front holder 64 from the temporary locking state to the regular locking state. For operating the operational members 70, one of two hands holds the connector housing 62, and a thumb and a forefinger of the other hand hold and pull backward or push forward the operational members 70.

The number of the double locking plates 67 agrees with the number of the terminal receiving chambers, and a plurality of the double locking plates 67 project horizontally backward from a bottom part and a middle part of the frame 68. The connector housing 62 includes terminal chambers in two steps up and down. The locking lances 66 project forward from rear parts of a bottom and a middle wall of the connector housing 62. The terminal 65 is a male terminal. A tabular contact 65*a* of the terminal 65 projects into the connector engaging chamber 63 through a hole of a front wall of a terminal receiving part 74 of the connector housing 62. At the temporary locking state, the double locking plate 67 is inserted into the terminal receiving part 74 from a lower opening of the hole. At the regular locking state, the frame 68 of the front holder 64 is engaged along the front wall of the connector housing 62. The connector-engaging chamber 63 is formed inside a hood 75. The hood 75 integrally extends to the terminal receiving part 74. A room for receiving a resilient locking arm of a mating connector (not shown) and a projection for engaging with the locking arm are formed at an upper side of the hood 75. Openings for inserting the operational members 70 are formed at left and right sides of a rear wall of the hood 75. The openings communicate with the connector-engaging chamber 63.

FIG. 17 shows another embodiment of the conventional double locking connector (see Japanese Patent Application No. H09-251874 (FIGS. 2 to 4)). A locking projection 80 as a temporary locking member and a locking projection 81 as a regular locking member are formed on operational members 79 at left and right sides of a front folder 77 (double locking member) of a double locking connector 76.

The operational members 79 are horizontally long frames. The projections 80, 81 are respectively formed on upper and lower side frames of the operational members 79. Projections 82, 83 corresponding respectively to the temporary and regular locking projections 80, 81 are formed on grooves on sidewalls of a connector housing 78. The operational members 79 projects from a front frame 84 in the same direction as double locking plates 85.

A sub wire harness is composed of such double locking connectors 61, 76, a plurality of electric wires, terminals, and other connectors. A wire harness is composed of a plurality of sub wire harnesses.

However, in such conventional double locking connectors, for example, when producing the wire harnesses or mounting the wire harnesses on a vehicle, electric wires may be caught in the operational members 70, 79 of the front holder 64, 77 and the operational members 70, 79 may be strongly bent outward to be deformed or damaged. Further, when pressing strongly to pry the operational members 70, 79 by fingers for treating the front holders 74, 77, the operational members 70, 79 may fall out of grooves of the connector housing 62, 78 and similarly be deformed, damaged, or at least reduced operability.

According to the above, an object of the present invention is to provide a double locking connector that prevents operational members thereof from being deformed and damaged even when the members are caught or pried, and allows the members to be shifted smoothly and surely.

SUMMERY OF THE INVENTION

In order to attain the object, according to the present invention, there is provided a double locking connector including:

a connector housing;

a double locking member inserted into the connector housing for locking terminals;

operational members disposed on the double locking member and exposed outside of the connector housing;

slidably engaged members disposed on the operational members;

guides disposed on outer walls of the connector housing; and pressing walls disposed on the guides for pressing the slidably engaged members from outside thereof to prevent the slidably engaged members from being displaced outward.

According to the above, when the double locking member is slid and inserted into the connector housing, the operational members are exposed outside of the connector housing. While inserting the double locking member, the slidably engaged members of the operational members are slid and engaged with the guides of the outer walls of the connector housing. Simultaneously, the pressing walls of the guides slidably press the slidably engaged members from outside thereof to prevent the slidably engaged members from being displaced outward. Resultingly, even when the electric wire is caught in the operational members or an operator pries the operational members, the operational members are prevented from being deformed and able to be slid smoothly. A plate-like rib, L-sectional, and T-sectional projected lines, and T-sectional grooves are applicable as the slidably engaged member. L-sectional and T-sectional rails, and a groove are applicable as the guide. A front holder and a rear holder are applicable as the double locking member. Preferably, the guide having the pressing wall overlaps or surrounds the slidably engaged member. Double locking the terminal may be carried out by preventing a locking lance that simply locks the terminal from bending, or by locking the terminal directly.

According to the present invention, preferably, the slidably engaged members are boards or ribs projecting from the boards, and the guide is an L-sectional guide rail.

According to the above, as the double locking member is inserted into the connector housing, the straight plate or rib is slid and engaged with a guiding groove in the guide rail. The pressing wall outside of the guide rail prevents the plate or the rib from shifting outward (opening outward). Preferably, the ribs or the guide rails are formed in a symmetrical pair. The plate having the rib may be thicker than the plate having no rib for improving rigidity. The plate having no rib makes the connector simple.

According to the present invention, preferably, the operational member includes a peripheral frame and a board, and the guide is inserted into an opening between the peripheral frame and the board.

According to the above, as the double locking member is inserted, the guide rail is inserted into the opening of the operational member along the board, relatively slid on and engaged with the board or the rib. If a pair of the guide rails is mounted, the guide rails are inserted into the openings at both sides of the board, relatively slid on, and engaged with the boards or the ribs. The board having the rib is inserted into the pair of the opening of the guide rail and positions the operational member accurately.

According to the invention, preferably, the peripheral frame of the operational member includes an operational part an operational part that connects the board and side parts. The side parts are arranged on both sides of the board. The operational part projects higher than the board and has an inner gateway continued to the opening.

According to the above, the operational part connects the board disposed at the center of the operational member and the side parts. Therefore, rigidity of the operational member is improved. Sliding operability with the long operational part is improved.

According to the invention, preferably, the double locking member includes temporary and regular locking members.

According to the above, the terminal is inserted into the double locking member and temporarily locked by the locking lance. Then by pushing the double locking member into the connector housing, the terminal is regularly locked and double locked by the double locking member in a manner that deformation of the locking lance is prevented.

According to the invention, preferably, the locking members are projections disposed at resilient side parts. A guiding wall having a mating member corresponding to the projections and a pressing member for pressing the projections is formed on the connector housing.

According to the above, the double locking member is inserted into the connector housing and temporarily locked by an engagement between the temporary locking projection and the mating member. Then, the terminal is inserted into the connector housing. Then, the double locking member is pushed to lock the terminal regularly by an engagement between the regular locking projection and the mating member. The temporary and regular locking projections may be the same, or separated. The pressing member of the guide covers the locking projections. The pressing member presses the locking projections to prevent the operational member from opening outward. The projections support an operation of the slidably engaged member (board or rib). A step, a recess, or a projection is applicable as the mating member.

According to the invention, preferably, the temporary locking member is disposed on a main body of the double locking member, and the regular locking member is disposed on the resilient side part of the operational member.

According to the above, the temporary locking member of the main body temporarily locks the double locking member on the connector housing. Then, the terminal is inserted. Then, by pushing the double locking member, the terminal is regularly locked with the regular locking member. A resilient arm or a small projection is preferable as the temporary locking member. In this case, a pressing wall for pressing the arm as the mating member or a recess for an engagement with the small projection is formed on the connector housing. A projection or a recess disposed on the resilient side part is preferable as the regular locking member. In this case, a projection or a recess is formed on the connector housing as the mating member. Because the temporary locking is carried out by a hand pushing and inserting the main body into the connector housing, the temporary locking member on the main body makes the temporary locking smooth and reliable. Further, because the regular locking is carried out by an operator's hand pulling or pushing the operational member, the regular locking member of the operational member makes the regular locking smooth and reliable.

These and other objects, features, and advantages of the present invention will become more apparent upon reading of the following detailed description along with the accompanied drawings.

DETAILED DESCRIPTION OF THE PREFERRED EMBODIMENTS

First Embodiment

Figure 1:
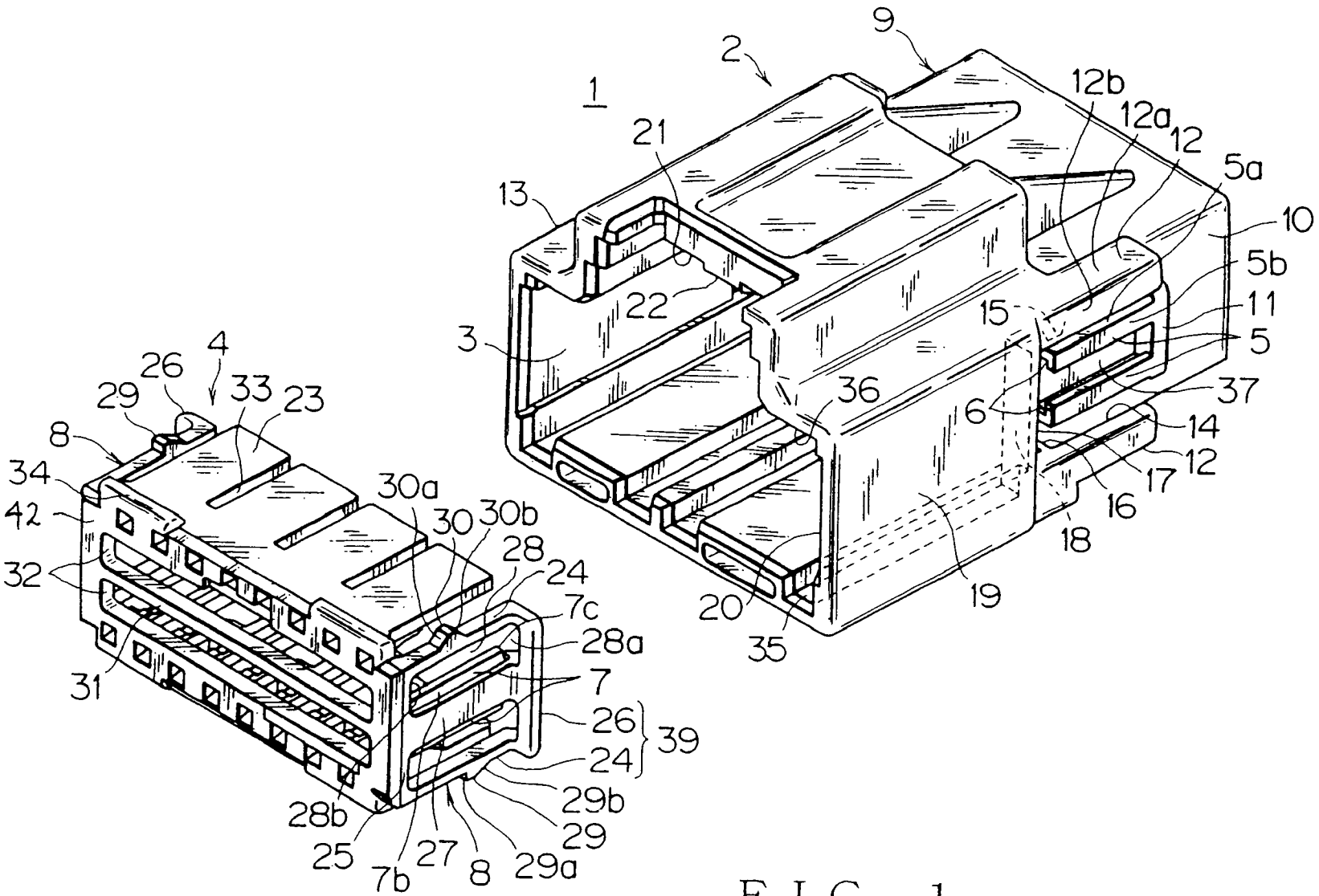
FIG. 1 is an exploded perspective view showing a double locking connector according to a first embodiment of the present invention.

A double locking connector 1 according to a first embodiment of the present invention will be described with reference to FIGS. 1 to 7. As shown in FIG. 1, the double locking connector 1 is formed of a synthetic-resin-made connector housing 2, a synthetic-resin-made front holder 4 (double locking member) to be inserted into the connector housing from a front opening of a connector fitting room 3, and terminals 41 (FIG. 7) to be received in the connector housing. Guide rails (guides or first guiding walls) 5 having guiding grooves 6 are formed on the connector housing 2. Ribs (projected lines or slidable engaged members) 7 for slidably engaging with the guiding grooves 6 are formed on an operational member 8 of the front holder 4.

The upper and lower guide rails 5 are symmetrically extended along both left and right sides of sidewalls 10 disposed on a terminal receiving chamber 9 which is a rear part of the connector housing 2. The guide rails 5 are formed in a substantially L-sectional shape and extended from a supporting wall (support) 5*a* projected from an outer wall of a sidewall 10, and pressing wall (pressing part) 5*b* perpendicular to the support wall 5*a*. The guiding grooves 6 are formed in a substantially L-sectional shape by the outer wall of the sidewall 10, the supporting wall 5*a*, and the pressing wall 5*b*. Both upper and lower guide rails 5 are connected at a rear side of the connector housing 2 to the sidewall 10 and connecting wall 11 projected vertically from the sidewall 10, and therefore, strength of the guide rails 5 is increased. A horizontally long space 37 is formed between the guide rails 5.

A front half of the connector housing 2 is a hood 13, and a rear half of the connector housing 2 is the terminal-receiving chamber 9. Upper and lower second guiding walls 12 are disposed on outer walls of a rear part of the hood 13 and an outer wall of the terminal-receiving chamber 9 parallel to the upper and lower guide rails 5. The upper second guiding wall 12 is disposed above the upper guide rail 5 with a gap, and the lower second guiding wall 12 is below the lower guide rail 5 with a gap. Each guiding wall 12 is formed in a substantially L-shape by horizontal supporting wall (support) 12*a* and a vertical pressing wall 12*b* perpendicular to the supporting wall 12*a*. Each guiding wall 12 has a second guiding groove 14 having a rectangular section and surrounded in a substantially U-shape by the outer wall of the sidewall 10, the supporting wall 12*a*, and pressing wall 12*b*.

A step 15 for being temporarily and regularly locked is formed in the guiding groove 14 of a front upper guiding wall 12 in FIG. 1. A step 16 or a projection for being temporarily locked is formed in the guiding groove 14 of a lower guiding wall 12. A step or a projection for temporarily locking is formed rotationally symmetrical with respect to the steps 15, 16 in a rear upper guiding wall (not shown). A step or projection for temporarily or regularly locking is formed on a rear lower guiding wall (not shown). Each of steps 15, 16 or projections are connected integrally to the outer wall of the sidewall 10, and the pressing wall 12*b* through the guiding groove 14.

Each front end of the guide rails 5 is disposed with a gap from a rear end (rear wall) 17 of the hood 13. The guiding wall 12 is integrally extended from the rear wall 17 of the hood 13. An oblong opening 18 is formed on the rear wall 17 facing the upper and lower guiding walls 5 and the guiding walls 12. The guiding grooves 14 of the guiding walls 12 communicate with the opening 18 at lower and upper end thereof. The opening 18 communicates with the connector fitting room 3 inside the hood 13. The opening 18 also communicates with guiding grooves 20 in a connector fitting direction. The guiding grooves 20 are disposed at left and right inner walls of sidewalls 19 of the connector fitting room 3.

A recess 21 for receiving a locking arm of the mating connector (not shown) is formed a top of the hood 13. A projection 22 for locking a projection of the locking arm is formed in the recess 21. The connector housing 2 of the present invention receives the male terminals 41 with electric wires like the conventional connector housing. Tabular contacts 41*a* (FIG. 7) of the male terminals 41 are projected in the connector fitting room 3 inside the hood 13.

Figure 7:
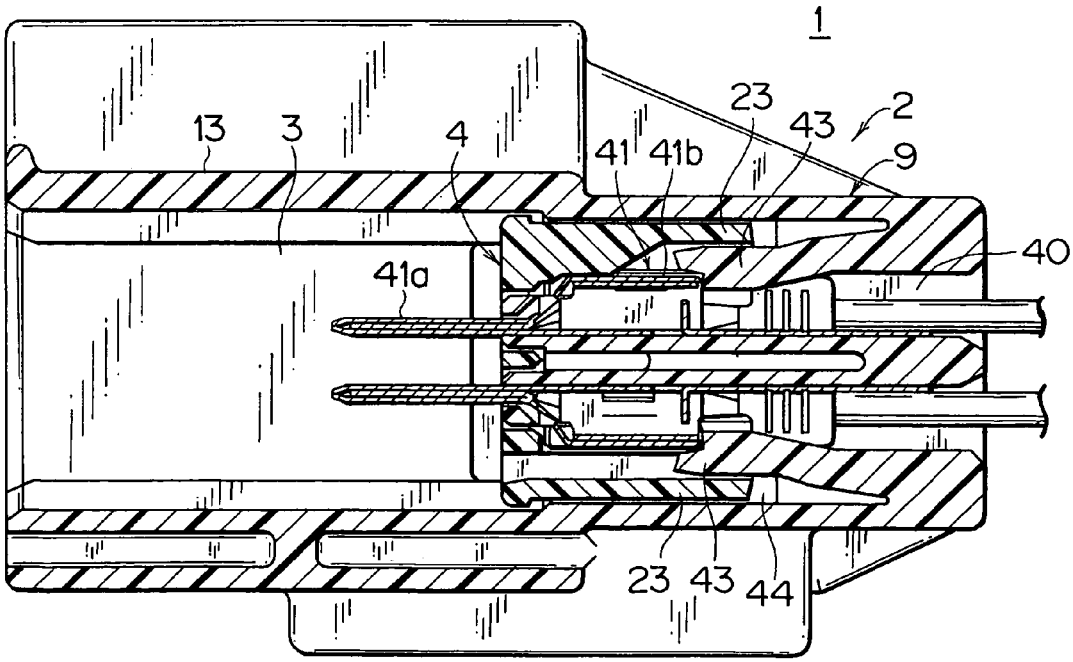
FIG. 7 is a longitudinal sectional view showing the assembled double locking connector in FIG. 1.

As shown in FIG. 7, the terminal-receiving chamber 9 of the connector housing 2 is formed of two steps up and down parallel to each other like the conventional connector housing. Resilient locking lances 43 of the connector housing 2 temporarily lock rear ends of box-like members 41*b* of the male terminals 41. The male terminals 41 are received in the mating connector (not shown). When the connectors are connected to each other, the tabular contacts 41*a* are inserted into holes in a front wall of the mating connector housing, and the terminal is electrically connected. In the first embodiment, male terminals are symmetrically arranged up and down in two steps of the terminal-receiving chamber 9. The upper terminals are arranged downward, and the lower terminals are arranged upward. Both flat bodies of the upper and lower terminals face each other.

As shown in FIG. 1, the front holder 4 includes: a vertical front base wall 42 having a substantially rectangular frame shape; a plurality of plate-shaped double locking members 23 extended backward horizontally parallel to each other from upper and lower parts of the base wall 42; and operational members 8 extended backward from right and left sides of the base wall 42, of which lengths are substantially same as those of the double locking members 23.

The operational member 8 includes: a peripheral member 39 having top and bottom sides 24, and front and rear sides 25, 26; and an intermediate board 27 disposed in a middle height of the peripheral member 39 and connecting the front and rear (operational) sides 25, 26 integrally. The top and bottom sides 24 are made relatively thin and resilient in a thickness (vertical) direction. The top and bottom sides 24 and the intermediate board 27 are disposed in a same vertical plane. The rear side 26 is bent and projected outward from rear ends of the top and bottom sides 24 and the intermediate board 27.

Horizontally long openings 28 are formed between the top and bottom sides 24 and the intermediate board 27. The opening 28 is opened backward at the rear side 26. The rear opening (entrance) 28*a* is vertically opened from the plane of the top and bottom sides and the intermediate board 27. Ribs for slidable engagement are projected from the intermediate board vertically upward and downward and extended along the intermediate board 27 in the opening 28. Thickness of the ribs is shorter than projected length thereof. Inner walls 7*a* (FIG. 4) of the ribs 7 and inner walls 27*a* of the intermediate board are respectively disposed in the same plane at left and right sides of the front holder 4. Outer walls 7*b* of the ribs 7 are disposed inner than those of the intermediate boards 27. Front ends of the ribs 7 are integrally continued to front ends 28*b* of the opening 28, and rear ends 7*c* of the ribs 7 are disposed at front ends of the rear openings 28*a*.

Projections 29 for temporarily locking or projections 30 for temporarily and regularly locking are formed on outer walls of the top and bottom sides 24. The projections 29 and 30 are rotationally symmetric with regard to the operational members 8 at right and left sides of the front holder 4 respectively. The projection 30 is formed in a substantially isosceles triangle shape and has front and rear locking walls 30*a*, 30*b*. The projection 29 is formed in a right-angled triangle shape and has a front vertical wall 29*a* and a rear inclined wall 29*b*.

The projection 30 is disposed around a center of one of the top or bottom side 24 in a longitudinal direction. The projection 29 is disposed backward from the projection 30 at the other side 24. The projection 30 corresponds to the step 15 or projection in one guiding wall 12 of the connector housing 2 for temporarily and regularly locking. The projection 29 corresponds to the step 16 or projection in the other guiding wall 12 for temporarily locking.

The pair of top and bottom projections 29, 30 is slidably engaged with the pair of upper and lower guiding walls 12 of the connector housing 2. The outer walls of the projections 29, 30 contact the inner walls of the pressing walls 12*b* of the guiding walls 12. Thus, the projections 29, 30 work like the ribs to prevent the operational member 8 from opening outward.

The front sides 25 of the left and right operational members 8 are continued integrally to the rear wall of the base wall 42. Each operational member 8 faces each other and is disposed perpendicular to the base wall 42. Horizontally long openings 32 for inserting terminals are respectively formed above and under a horizontally long partition wall 31. The partition wall 31 is disposed at a middle height of the base wall 42. A plurality of double locking members 23 are extended backward from top and bottom ends of the base wall 42. Slits 33 separate the double locking members 23 from each other. Front ends of the double locking members 23 are integrally extended to the top and bottom ends of the base wall 42. Projected lines for stopping the connector housing 2 are formed on the both top and bottom ends of the base wall 42. Male terminals arranged in two steps up and down (not shown) in the connector housing 2 are inserted into the horizontally long openings 32.

As shown in FIG. 1, the front holder 4 is inserted into the fitting room 3 of the connector housing 2. The left and right operational members 8 are smoothly inserted into grooves (recesses) 20 in left and right inner walls of the sidewalls and into grooves 35 of the fitting room 3. The grooves 35 are disposed on an inner wall of the bottom wall of the fitting room 3. The rear sides 26 of the operational members 8 are inserted into the grooves 20. The up and down projections 29, 30 are inserted into the lower grooves 35 and upper rooms 36 facing the grooves 35.

Figure 2:
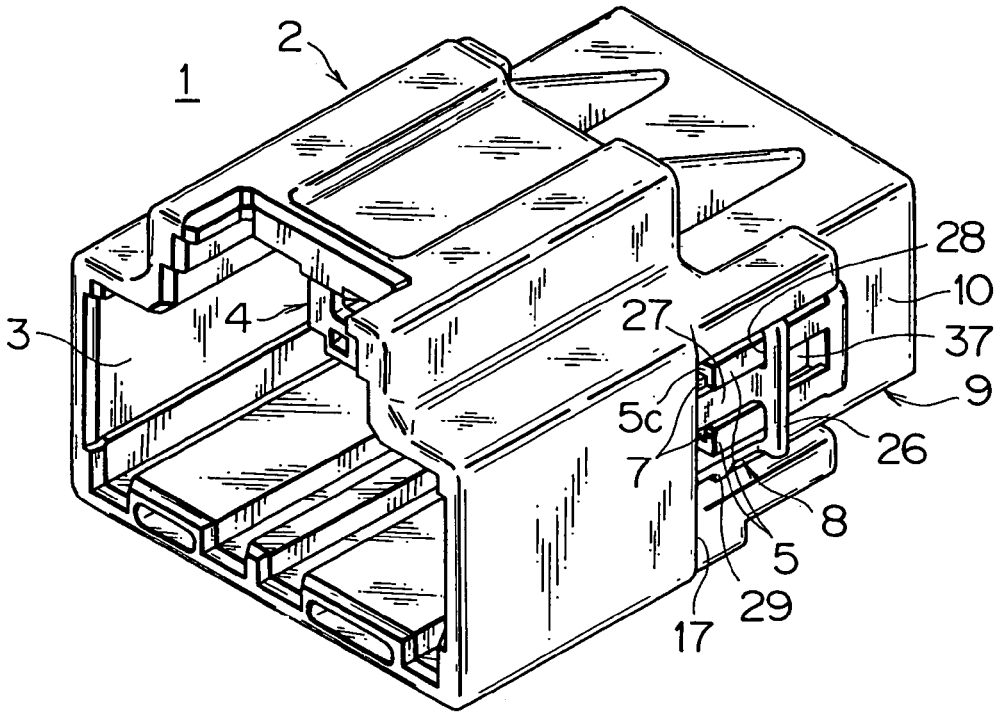
FIG. 2 is a perspective view showing a temporary locked front holder of the double locking connector in FIG. 1.
Figure 3:
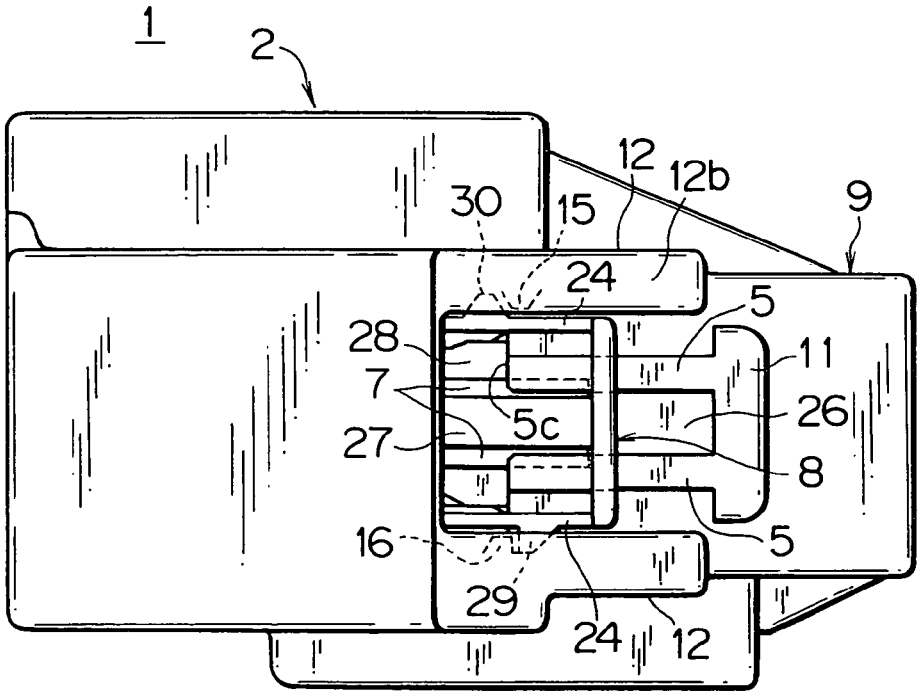
FIG. 3 is a side view showing the temporary locked front holder of the double locking connector in FIG. 1.

FIGS. 2 to 3 show a temporary locked front holder 4 with the connector housing 2. The operational members 8 are projected outward from the opening 18 (FIG. 1) of the rear wall 17 of the fitting room 3 and shifted along the outer wall of the sidewall 10 of the terminal receiving chamber 9. As the intermediate boards 27 are inserted into the horizontally long spaces 37, the ribs 7 are slidably inserted into the guide rails 5. Front ends 5*c* of the guide rails 5 are inserted into the openings 28 through the rear openings 28*a* of the operational members 8.

Figure 4:
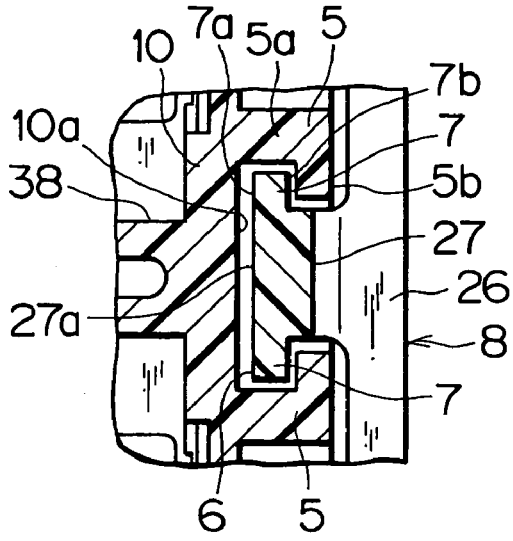
FIG. 4 is a longitudinal sectional view showing an engagement between an operational member of the front holder and a connector housing of the double locking connector in FIG. 1.

In FIG. 4, the ribs 7 are engaged with the guide rails 5. The pressing walls 5*b* respectively press the top and bottom ribs 7 toward the interior of the connector housing 2 to prevent the operational members 8 from opening outward.

In other words, even when the operational member 8 catches the electric wire of a wire harness (not shown), or is pried, because the ribs 7 are engaged with the guiding grooves 6, the operational members 8 is prevented from being deformed outward or damaged. Resultingly, the front holder 4 is smoothly and reliably attached and detached with the operational members 8 in the temporary locking state. Similarly, the front holder 4 is smoothly and reliably attached and detached in the regularly locking state.

As shown in FIG. 4, the intermediate board 27 is received in between the vertical pressing walls 5*b* and the horizontal supporting walls 5*a*. The outer wall of the intermediate board 27 is positioned between the front ends of the top and bottom pressing walls 5*b*. The rib 7 is slidably engaged in a room having a substantially U-section surrounded by the supporting walls 5*a*, the pressing walls 5*b*, and an outer wall 10*a* of the sidewall 10. A small gaps exists between the intermediate board 27 and the pressing walls 5*b*, between the front end walls of the ribs and the supporting walls 5*a*, and between the inner wall of the intermediate board 27 and the outer wall of the sidewall 10. The intermediate board 27 is continued to the rear side 26 through the rear curved parts. The upper and lower sides 24 are positioned above and below the guide rails 5. An inner wall of the sidewall 10 is continued to a horizontal partition wall 38 in the terminal-receiving chamber 9.

As shown in FIG. 3, the projection 29 is shifted over the step 16 and contacts a backside of the step 16. The projection 30 contacts a front side of the step 15. Thus, the front holder 4 is temporarily locked. Then, male terminals having wires are respectively inserted into the cells inside the terminal-receiving chamber 9, and locked with resilient locking lances in the cells. End walls of the sides 24 and top and bottom ends of the rear side 26 are positioned in the vicinity of a front end wall of the pressing wall 12*b*. In the temporary locking state, the intermediate board 27 and the ribs 7 are positioned in a front half of the guide rails 5 and engaged.

The temporary and regularly locking state of the front holder 4 is carried out by an operator grasping and pulling backward the rear sides 26 of the operational members 8 with fingers (thumb and forefinger). Because the top and bottom sides 24 and the intermediate board 27 are disposed inner than the outer wall of the guide rails 5, they are prevented from being pressed by the fingers directly. The rear side 26 is projected to substantially the same plane as the outer wall of the upper and lower guiding walls 12.

Figure 5:
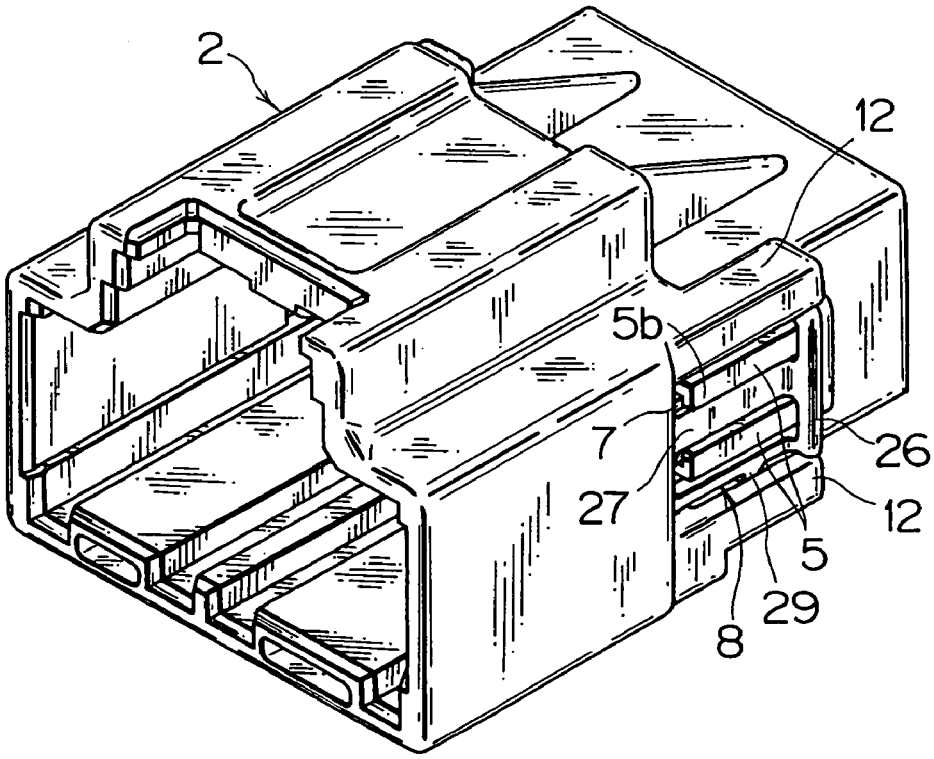
FIG. 5 is a perspective view showing the regularly locked front holder of the double locking connector in FIG. 1.
Figure 6:
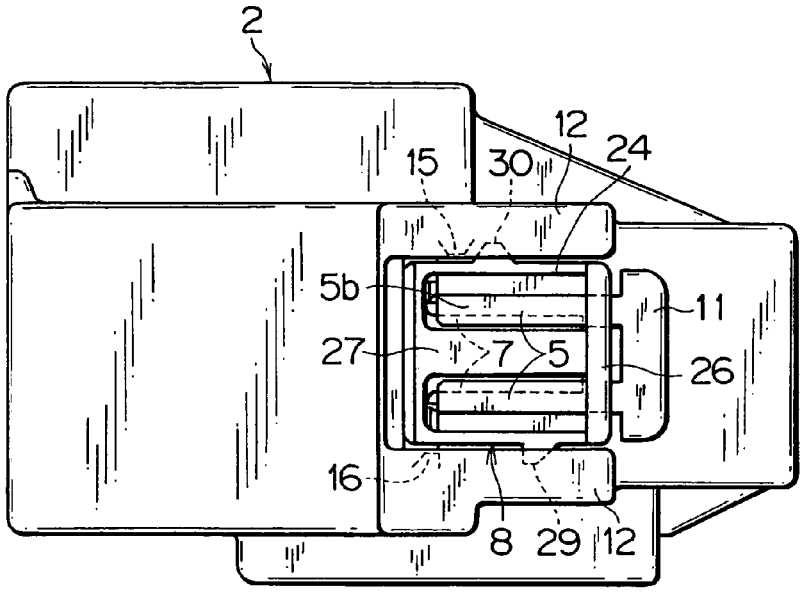
FIG. 6 is a side view showing the regularly locked front holder of the double locking connector in FIG. 1.

The operational members 8 are slid backward from the temporary locking state shown in FIGS. 2 and 3. Then, the front holder 4 is in the regularly locking state shown in FIGS. 5 to 7. As shown in FIGS. 5 to 6, The rear side 26 is positioned in front of the connecting wall 11. Rear ends of the guiding walls 12 are positioned above and below the rear side 26. The rear side 26 is surrounded on three sides by the connecting wall 11 and the guiding walls 12. Thus, the rear side 26 is completely protected from outer interference or the like.

As shown in FIG. 6, the projection 30 is shifted over the step 15 and contacts the rear side of the step 15. Thus, the front holder 4 is prevented from shifting forward. The projection 29 is far from the step 16.

Almost all lengths of the top and bottom ribs 7 are inserted along the guide rails 5. The pressing walls 5*b* firmly support the ribs 7 and prevent the ribs 7 from shifting outward. Thus, the operational members 8 are reliably prevented from being deformed and damaged caused by catching the electric wires or being pried.

As shown in FIG. 7, each locking member 23 is inserted into a gap 44 of the locking lance 43 to prevent the locking lance 43 from being unintentionally deformed, and prevent the terminal 41 from shifting backward. Thus, the double locking members 23 reliably double-lock the terminals 41. When the insertion of the terminal 41 is insufficient, the lance 43 is kept deformed, and the front end of the double locking members 23 pushes the front end of the lance 43 and cannot push further. Thus, the insufficient insertion is detected.

Incidentally, in the first embodiment, the front holder 4 double-locks the terminal having the electric wire. However, for example, the front holder 4 of a direct-mount type double-lock connector without using electric wire can double-lock a terminal continued to a bus bar in a device according to the invention.

Further, the number of the steps of the terminal-receiving chamber 9 is not limited to two. Steps more than two steps or one step are acceptable. If the number of steps is one, the front holder 4 can be formed in a plate shape.

Further, as the locking member of the front holder 4 for the connector housing 2, two projections for temporarily and regularly locking may be disposed back and forth on the top and bottom sides 24. Two steps or projections corresponding to the two projections may be disposed on the guiding walls 12. In addition, as shown in FIG. 7, the locking members may not be disposed on the operational members 8 like conventional connectors. In this case, the top and bottom sides 24 of the operational members 8 are not required to be resilient.

Further, instead of the opening 32, for example, the front holder 4 may include terminal insertion holes for respective terminals to be positioned at rear walls of the terminal-receiving chamber 9. Further, the front holder 4 may include slit-shaped insertion holes for preventing the tabular contacts of the male terminals from falling down.

Further, the rear side 26 may be only disposed on the rear side of the intermediate board, and rear ends of the top and bottom resilient sides 24 may be free ends. Thus, the rear openings 28*a* surrounded by the rear side 26 may be canceled. However, in this case, operability of the rear side 26 having shorter length may be reduced, and locking force of the projections 29, 30 may be reduced.

Further, the guide rails 5, the operational members 8, and the ribs 7 may be formed on upper and lower walls of the connector housing 2. Thus, the operational members 8 may be projected outward through upper and lower openings 18. The same way may be carried out on a later-described rear holder. Of course, definitions of top, bottom, upper, lower, right, and left are carried out for the shake of convenience.

Figure 8:
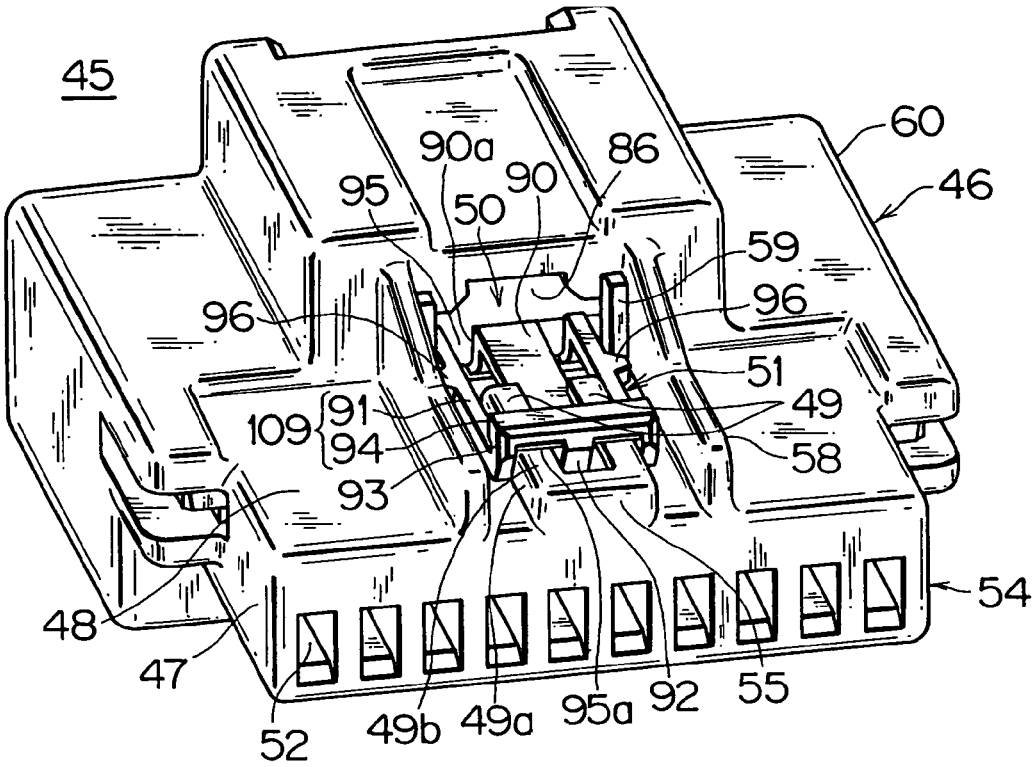
FIG. 8 is a perspective view showing a double locking connector according to a second embodiment of the present invention.

Further, in the first embodiment, the double locking members 23 are extended from the upper and lower ends of the front holder 4. However, as shown in FIG. 8, the double locking members 23 may be disposed on the middle and lower sides, or on the middle and upper sides of the front holder 50. The number of double locking members 23 and the number of the steps of the same may be set properly corresponding to the number, and the numbers of the steps of the terminal receiving rooms. The shape of the double locking members 23 may be set properly such as a plate, a rod, a bar, or the like.

Further, in the first embodiment, guide rails 5 having substantially inverted L-shaped sections may be disposed on the operational members 8. The ribs 7 having substantially the inverted L-shaped sections may be formed on the connector housing 2. Further, for example, grooves having substantially T-shaped sections may be disposed on the middle of the intermediate board 27 instead of the ribs 7. Projected lines having substantially T-shaped sections may be disposed on the connector housing 2 for slidably engaging with the grooves. A projected line having substantially T-shaped section may be formed on a back wall (inner wall) of the intermediate board 27. A pair of guide rails may be formed in the gap 37. Further, if the projections 29, 30 are not disposed on the sides 24, ribs 7 may be disposed on inner sidewalls of the top and bottom sides 24 having thicker width. Guide rails 5 having substantially L-shaped sections may be disposed on the sidewall 10 of the connector housing 2. In any case, the guides have pressing walls for preventing the operational members 8 from shifting outward. Further, in FIG. 1, only one rib 7 may be disposed and only one guide rail 5 may be disposed. Even in this case, the guide rail 5 surrounds the rib 7 for preventing the operational members 8 from opening outward.

Further, according to the first embodiment, a rear holder may be used instead of the front holder 4.

Further, if the double locking members 23 are disposed on the rear holder, the rear holder may directly lock the steps of the terminals or projections.

Second Embodiment

A double locking connector 45 according to a second embodiment of the present invention will be described with reference to FIGS. 8 to 13.

Guide rails 49 are integrally formed on a horizontal upper wall (outer wall) 48. Operational members 51 are horizontally projected backward from a front holder (double locking member) 50 made of synthetic resin. An intermediate board (slidably engaged member) 90 of the operational member 51 is to be slidably engaged with the guide rails 49.

Like the first embodiment, the guide rails 49 engaged with the operational members 51 prevent the operational members 51 from opening outward. Terminal receiving rooms 52 are arranged in a thin single step. A main body 53 (except the operational members 51 (FIG. 10)) of the front holder 50 is formed in substantially a plate shape.

As shown in FIG. 8, a pair of left and right guide rails 49 are disposed in a middle width of an upper wall 48 of a terminal-receiving chamber 54. Rear ends of the rails 49 are connected to each other via the connecting wall 55.

Figure 11:
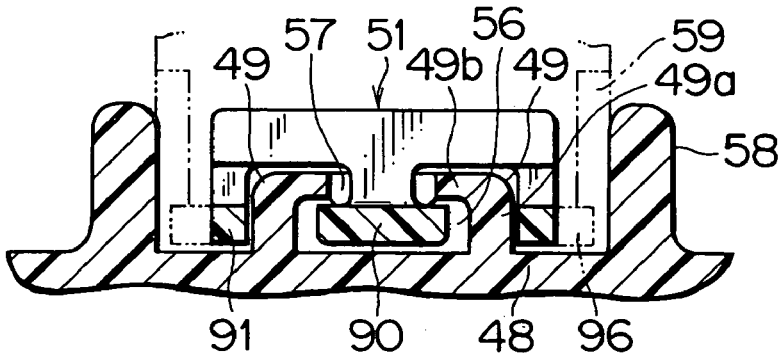
FIG. 11 is a longitudinal sectional view showing an operational member and a support thereof of the double locking connector in FIG. 8.

As shown in FIG. 11, the guide rails 49 is formed in substantially an L-shaped section by supporting wall 49*a* and pressing wall 49*b*. A guiding groove 56 (FIG. 11) is surrounded in substantially a U-shape by the upper wall 48, the supporting wall 49*a*, and the pressing wall 49*b*. The connecting wall 55 reinforces the guide rails 49. A horizontally long room 57 (FIG. 11) is formed between the guide rails 49.

A pair of protecting walls 58 are extended from the upper wall 48 for covering the guide rails 49. Projecting lines 59 are vertically formed on inner walls of the protecting walls 58. The protecting walls 58 are continued from rear wall of a hood 60 disposed at a front half of the connector housing 46. An opening 86 is opened at the rear wall of the hood 60 for inserting the operational members 51.

Figure 9:
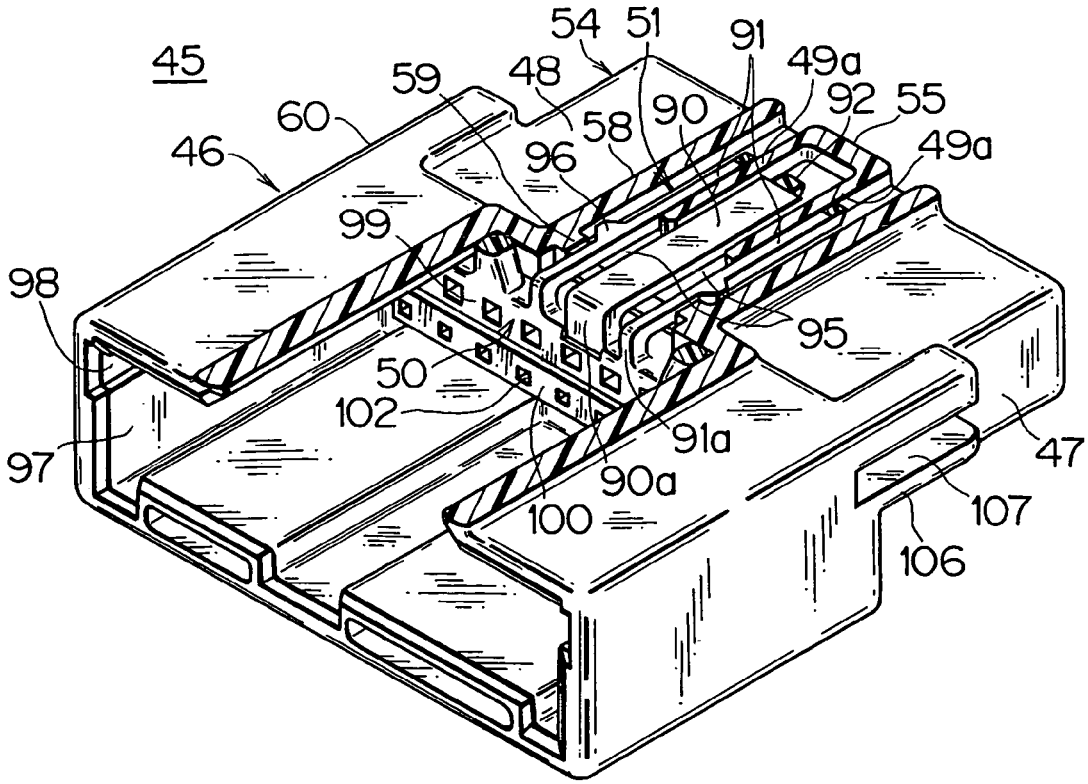
FIG. 9 is a top sectional perspective view showing the double locking connector in FIG. 8.
Figure 10:
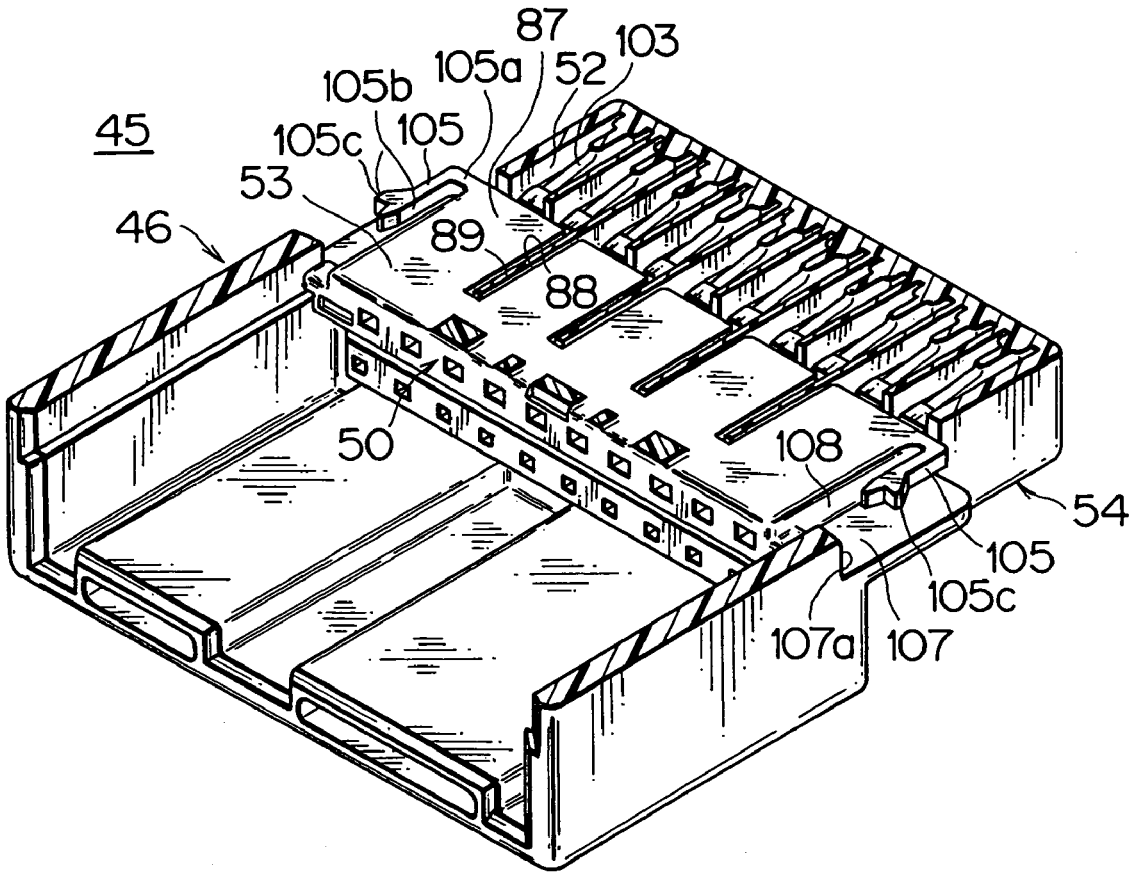
FIG. 10 is a center sectional perspective view showing the double locking connector in FIG. 8.

FIGS. 8 to 10 show the front holder 50 pushed fully into the connector housing 46 and regularly locked. The front holder 50 includes the substantially plate-shaped main body 53, and the operational members 51 standing on the main body 53 and horizontally extended backward. The main body 53 includes a plurality of plate-shaped double locking members 87 (FIG. 10) for locking terminals. Slits 88 split the double locking members 87. Partitioning walls 89 (FIG. 10) in the terminal-receiving chamber 54 of the connector housing 46 are inserted into the slits 88 to position the front holder 50 without rattle.

Each operational member 51 is formed in substantially a rectangular frame shape by the wide centered intermediate board 90 (slidably engaged member), right and left narrow resilient sides 91 disposed parallel to and at right and left sides of the intermediate board, a little narrow vertical side 92 vertically extending from a rear end of the intermediate board 90, and vertical sides 93 extending from rear ends of the right and left sides 91 in substantially the same width as the right and left sides 91, and a rear (operational) side 94 connecting the vertical sides 92, 93. Vertically extending sides 90*a*, 91*a* of front ends of the intermediate board 90 and the right and left sides 91 integrally extend perpendicular to an upper front end of the main body 53 of the front holder 50. A peripheral member 109 is formed in substantially a frame shape by the intermediate board 90 and the left and right sides 94.

The intermediate board 90 is engaged slidably with the guide rails 49 and a top wall (outer wall) of the intermediate board 90 contacts the bottom walls (inner wall) of the pressing walls 49*b*. Thus, the operational members 51 are prevented from opening upward. The vertical side 92 is formed narrower than the intermediate board 90 so as to be insertable into between the pressing walls 49*b* of the guide rails 49. According to the second embodiment, a rib 7 (FIG. 1) is not used like the first embodiment. Both left and right sides of the intermediate board 90 are directly slidable. This manner is applicable in FIG. 1.

In other words, the ribs 7 in FIG. 1 may be canceled. A vertical rear side of the intermediate board 27 may be formed narrower and cross the rear side 26. An interval between the guide rails 5 may be narrower. The vertical side may be inserted into the pressing walls 5*b* of the guide rails 5. At the same time, top and bottom end of the intermediate board 27 may be slid into the pressing walls 5*b*.

On the contrary, according to the second invention in FIG. 8, the ribs (not shown) may be formed on left and right sides of the intermediate board 90 for being inserted into the guide rails 49. Since the ribs are thinner than the intermediate board 90, using the ribs reduces height of the guide rails 49.

As shown in FIG. 8, the rear side 94 is a little higher than the guide rails 49. Therefore, the guide rails 49 are insertable from an opening 95*a* formed by the operational side 94, the vertical side 92, and the vertical sides 93 into an opening 95 formed by the intermediate board 90 and the left and right sides 91.

As shown in FIGS. 8 to 9, the right and left resilient sides 91 are insertable along an outer wall of the supporting wall 49*a*. Projections 96 for regular locking are formed symmetrically on an outer wall of front halves of the sides 91. The projections 96 are formed in substantially a triangle shape having slopes back and forth. As shown in FIG. 8, the projections 96 is shifted over the projected lines 59 and front walls of the projections 96 contact rear walls of the projected lines 59, so that the front holder 50 is regularly locked. FIG. 9 shows horizontal sections of the projected lines 59, the guide rails 49, the vertical side 92, the protecting walls 58, and the hood 60.

Figure 13:
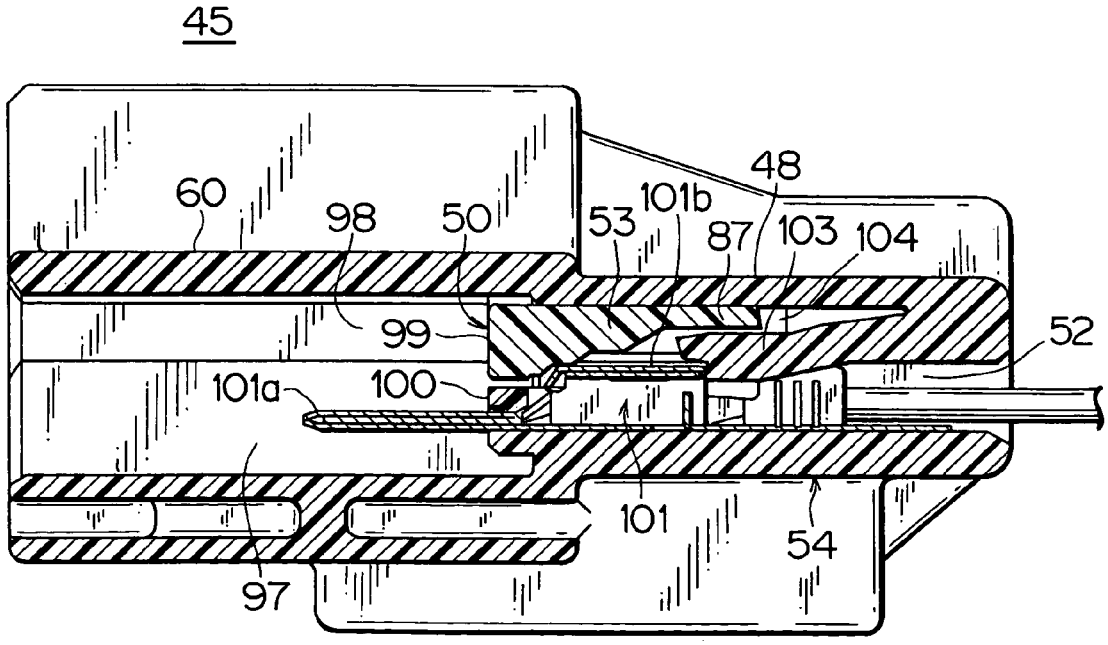
FIG. 13 is a longitudinal sectional view showing the assembled double locking connector in FIG. 8.
Figure 14:
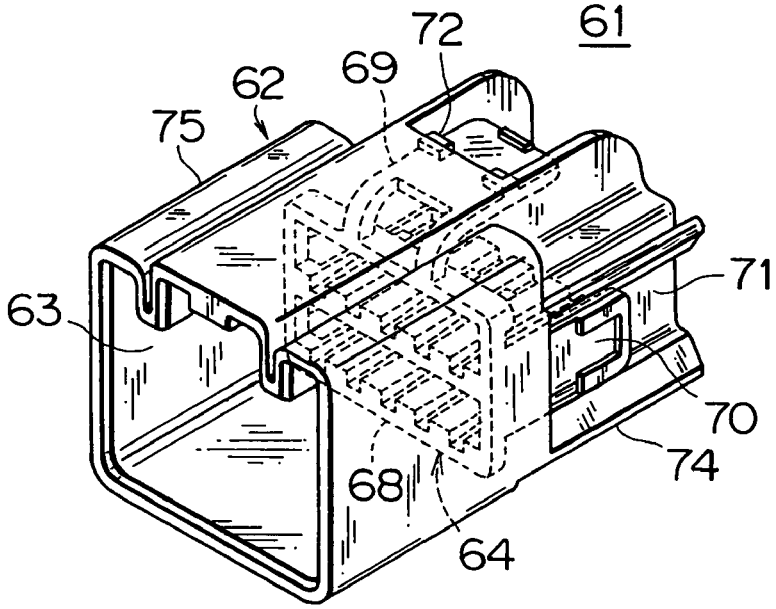
PRIOR ART FIG. 14
FIG. 14 is a perspective view showing a conventional double locking connector.
Figure 15:
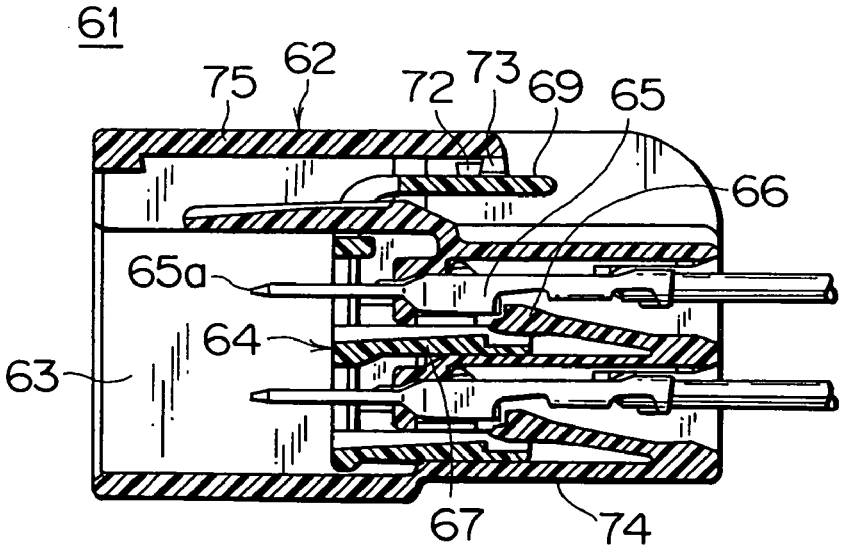
PRIOR ART FIG. 15
FIG. 15 is a longitudinal sectional view showing a temporarily locked front holder of the conventional double locking connector.
Figure 16:
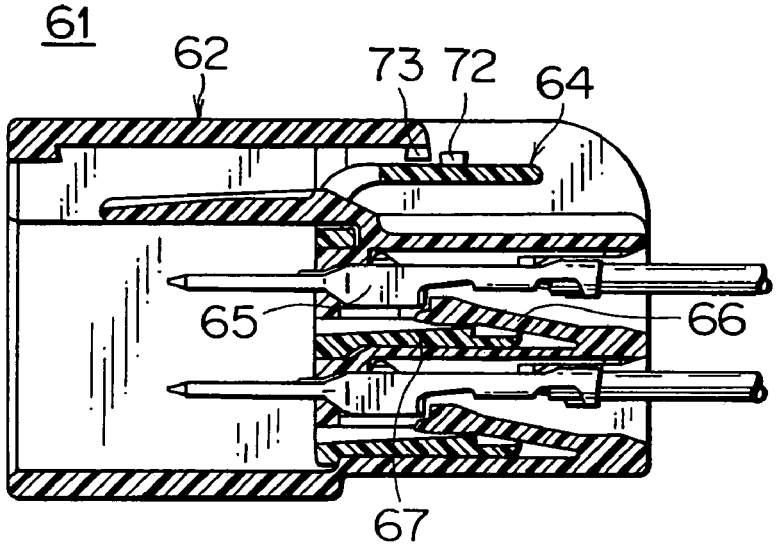
PRIOR ART FIG. 16
FIG. 16 is a longitudinal sectional view showing a regularly locked front holder of the conventional double locking connector.
Figure 17:
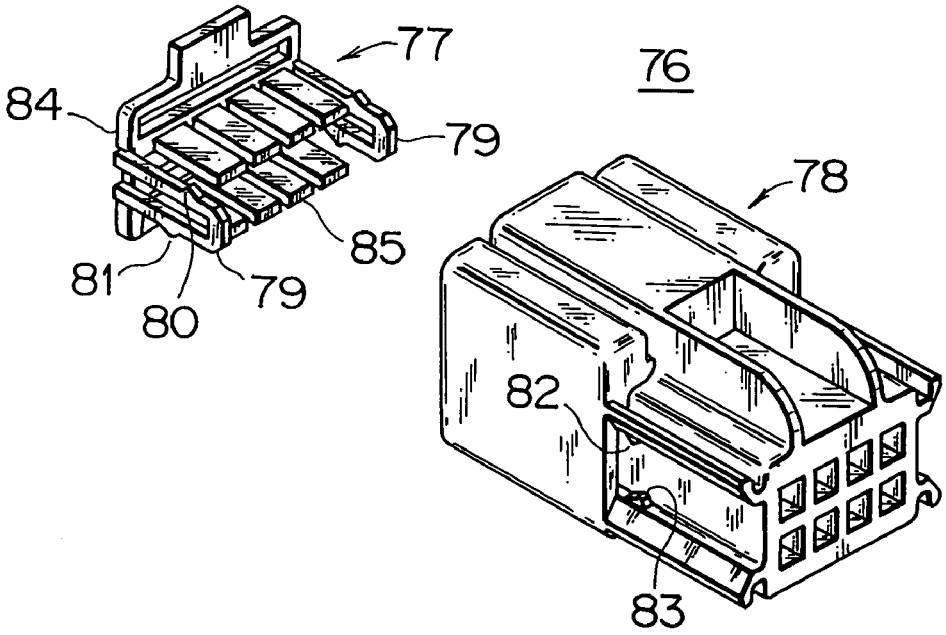
PRIOR ART FIG. 17
FIG. 17 is an exploded perspective view showing another conventional double locking connector.

As shown in FIGS. 9 and 13, the front holder 50 is inserted into between the upper wall 48 and the terminal-receiving chamber 52. The plate-shaped front holder 50 is inserted along a horizontal guiding groove 98 disposed at an upper side of a terminal-receiving chamber 97 of the connector housing 46. A base wall 99 at a front end of the front holder 50 is positioned in substantially the same plane as a front wall of the terminal receiving chamber 52 at a rear end of an upper wall of the hood 60 of the connector housing 46. Holes 102 for inserting tabular contacts 101*a* are disposed in parallel at a front wall 100 of the terminal-receiving chamber 52.

As shown in FIGS. 10 and 13, the double locking members 87 is inserted into rooms 104 at upper sides of locking lances 103 to prevent deformations of the locking lances 103. A rear half of the main body 53 of the double locking member 87 is formed thinner than a front half of the main body 53. The rear half of the main body 53 also works as an upper wall of the terminal receiving chamber 52 to hold a front half of a box part 101*b* continued to the tabular contacts 101*a* of the male terminals 101. The locking lances 103 locks the upper rear end of the box part 101*b*. The locking lances 103 are projected obliquely forward from an inner wall of the upper wall 48 of the terminal-receiving chamber 54.

As shown in FIG. 10, resilient temporary locking arms (temporary locking members) 105 are projected forward along side end walls of the front holder 50 in a half length of the main body 53 from the left and right rear ends of the double locking members 87 of the front holder 50. Each locking arm 105 is formed by a support 105*a* perpendicular to the side end wall, a main arm body 105*b* perpendicular to the support 105*a*, and a projection 105*c* disposed outward at a front half of the main arm body 105*b*.

Figure 12:
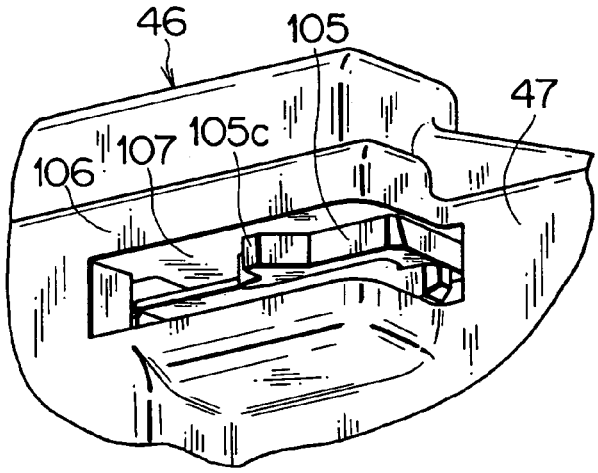
FIG. 12 is a perspective view showing a temporary locking member of the double locking connector in FIG. 8.

As shown in FIGS. 9 and 12, a wall 106 is bulgy formed in the same width as the hood 60 at a front half of both walls 47 of the terminal-receiving chamber 54. A horizontally long slit 107 is formed at a middle of the wall 106. As shown in FIG. 10, the slit 107 communicates with a holder-receiving room 108 in the terminal-receiving chamber 54. In the slit 107, the locking arm 105 of the front holder 50 is projected. Thus, the locking wall at the front end of the projection 105*c* is able to contact a front end wall 107*a* of the slit 107.

When the front holder 50 is temporarily locked, the projection 105*c* contacts the front end wall 107*a*, and the projections 96 (FIG. 9) contacts a front end wall of the projected lines 59. By pressing backward the temporary locked front holder 50, the locking arm 105 is bent inward and inserted into the slit 107 along the inner wall of the hood 60. Then, the locking arm 105 resiliently returns outward. The projections 96 in FIG. 9 are bent inward integrally with the resilient sides 91, sifted over the projected lines 59, and contact the rear end walls of the projected lines 59. Thus, the front holder 50 is regularly locked.

As shown in FIGS. 8 and 11, while the front holder 50 is regularly locked from being temporarily locked, the intermediate board 90 is slidably inserted into the guide rails 49, and the pressing walls 49*b* prevent the intermediate board 90 from shifting upward. The sides 91 are positioned along outer surfaces of the supporting walls 49*a*. The rear side 94 is projected upward from the guide rails 49.

Even when the rear side 94 catches the electric wire (not shown), or when the rear side is pried, because the intermediate board 90 is held in the guide rails 49, the operational members 51 including the left and right sides are prevented from rising up, being deformed, or damaged. Further, the operational members 51 can be smoothly slid with small force without any catch.

In FIG. 11, when an inward projection or projected line is formed on an inner edge of the pressing wall 49*b*, the vertical rattle of the intermediate board 90 between the pressing wall 49*b* and the upper wall 48 (in the guiding groove 56) of the connector housing 46 is further surely prevented.

Incidentally, in the second embodiment, the front holder 50 double-locks the terminal 101 having the electric wire. However, for example, the front holder 50 of a direct-mount type double-lock connector without using electric wire can double-lock a terminal continued to a bus bar in a device according to the invention.

Further, the number of the steps of the terminal-receiving chamber 52 is not limited to one. Steps more than one step are acceptable. In this case, for example, like the first embodiment, the double locking members 87 are projected from the base wall 99 in a plurality of steps, and the operational members 51 is formed on the main body 53 including the double locking members 87 in an upper step.

Further, the rear side 94 may be only disposed on the rear side of the intermediate board, and rear ends of the left and right resilient sides 91 may be free ends. Thus, the rear openings 95*a* surrounded by the rear side 94 may be canceled. However, in this case, operability of the operational member 94 having shorter length may be reduced and locking force of the projections 96 may be reduced.

Further, like the first embodiment, as the locking member of the front holder 50, the projections 96 and the projected lines 59 can be disposed back and force on the left and right sides 91 instead of the locking arm 105. Further, instead of the projected lines 59, step walls of the connector housing 46 can be used. Further, instead of the projections 96, for example, the locking arm 105 may be formed in a long shape and supported at both sides, and the projection 105*c* for temporary locking a projection for regular locking may be formed on the locking arm 105, and steps pr projections may be formed on the connector housing 46. In this case, the left and right sides 91 of the operational members 51 are not required to be resilient.

Further, in the second embodiment, the intermediate board 90 is slidably engaged on guide rails 49 having substantially L-shaped sections. However, for example, slidably engaged members having substantially an inverted L-shaped section (guide rail shape) may be disposed on the operational members 51. The ribs or guides having substantially the inverted L-shaped sections may be formed on the connector housing 64. Further, for example, grooves having substantially T-shaped sections may be disposed on the middle of the intermediate board 90. Projected lines (guides) having substantially T-shaped sections may be disposed on the connector housing 64 for slidably engaging with the grooves. A projected line (slidably engaged member) having substantially T-shaped section may be formed on a back wall (inner wall) of the intermediate board 90. A pair of guide rails having a narrow gap may be formed on the upper wall 48. In any case, the guide rails 49 include the pressing wall 49*b* for preventing the operational members 51 from sliding outward.

Further, the double-locking connector assembly according to the present invention may be formed by a male connector housing for receiving female terminals and a rear holder made of synthetic resin and having a rectangular or plate shape which is attached to a rear opening of the connector housing (not shown). A rear end of the guide rails 49 may be opened. The operational members 51 may be projected forward from the base wall. The rear end of the operational members 51 may be formed integrally with the rear holder. A front side having an opening may be projected outward at a front end of the operational members 51. Both ends of the intermediate board 90 may be disposed inside a horizontally long opening continued from the front opening. The double locking members 87 projected forward from the base wall 99 may prevent a deformation of the locking lances 103 projected outward in the connector housing.

Further, according to the second embodiment, the front holder 50 prevents the deformation of the locking lances 103. However, if a rear holder is used as the double locking member, the rear holder may directly lock the steps 101*b* of the terminals 101 or projections.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A double locking connector comprising:

a connector housing;

a double locking member inserted into the connector housing for locking terminals;

operational members, each including a peripheral frame having top and bottom sides, front and rear sides, and an intermediate board and openings formed between the top and bottom sides and the intermediate board, disposed on the double locking member and exposed outside of the connector housing;

each of the operational members having ribs disposed in the openings on sides of the intermediate board of the operational members;

guides having inner guide grooves disposed on outer walls of the connector housing; and, pressing walls disposed on the guides for pressing the ribs from outside thereof to prevent the ribs from being displaced outward.

2. The double locking connector as claimed in claim 1, wherein the guide is an L-sectional guide rail.

3. The double locking connector as claimed in claim 2, wherein the guide is inserted into an opening between the peripheral frame and the board.

4. The double locking connector as claimed in claim 3, wherein the peripheral frame of the operational member includes a projecting part that connects the board and side parts, said the side parts being arranged on both sides of the board, wherein the projecting part projects higher than the board and has an inner gateway continued to the opening.

* * * * *